United States Patent [19]

Richter

[11] Patent Number: 4,505,777

[45] Date of Patent: Mar. 19, 1985

[54] METHOD FOR PRODUCING ORIENTED FLEECES OR MATS OF SHORT LENGTH FIBERS

[75] Inventor: Heinz Richter, Ottobrunn, Fed. Rep. of Germany

[73] Assignee: Messerschmitt-Boelkow-Blohm GmbH, Munich, Fed. Rep. of Germany

[21] Appl. No.: 389,614

[22] Filed: Jun. 18, 1982

Related U.S. Application Data

[63] Continuation of Ser. No. 202,176, Oct. 29, 1980, abandoned.

[51] Int. Cl.[3] ..... D21F 1/06; D21H 5/12

[52] U.S. Cl. ..... 162/102; 162/212; 162/217; 162/343; 264/108

[58] Field of Search ..... 162/315, 318, 343, 338, 162/341, 346, 298, 299, 102, 212, 217; 264/108, 87; 425/467, 224, 85

[56] References Cited

U.S. PATENT DOCUMENTS

| | | | |
|---|---|---|---|
| 2,347,130 | 4/1944 | Seaborne | 162/343 |
| 3,216,892 | 11/1965 | Wahlstrom et al. | 162/343 |
| 3,328,236 | 6/1967 | Burgess et al. | 162/343 |
| 3,933,960 | 1/1976 | Cameon et al. | 264/108 |
| 4,205,921 | 6/1980 | Mahler | 162/343 |
| 4,271,112 | 6/1981 | Rossman et al. | 264/108 |

FOREIGN PATENT DOCUMENTS

| | | | |
|---|---|---|---|
| 2163799 | 8/1973 | Fed. Rep. of Germany | 264/108 |
| 362535 | 6/1931 | United Kingdom | 162/346 |

*Primary Examiner*—Steve Alvo

*Attorney, Agent, or Firm*—W. G. Fasse; D. H. Kane, Jr.

[57] ABSTRACT

The distribution and orientation of the fibers in a short fiber fleece is improved by flowing the fiber suspension onto the surface of a rotating drum through a plurality of relatively narrow channels formed in a chute. The channels may be parallel partition walls extending in the flow direction or the channels may be formed by hoses or pipes placed one next to the other on the chute. The flow speed at the exit end of the chute may be increased by narrowing the exit end cross-sectional area.

5 Claims, 9 Drawing Figures

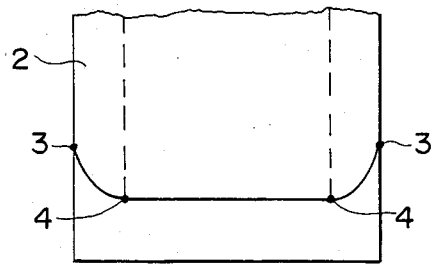
PRIOR ART FIG. 1
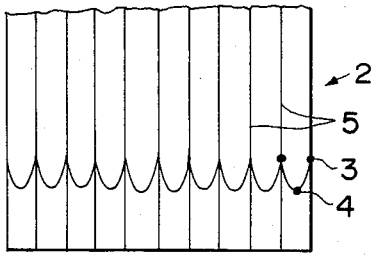
FIG. 2
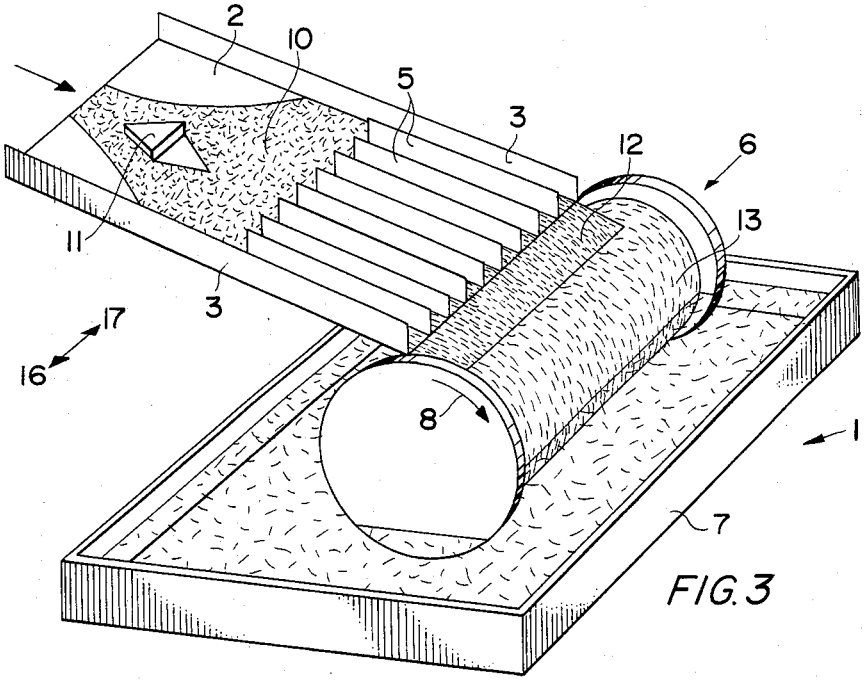
FIG. 3
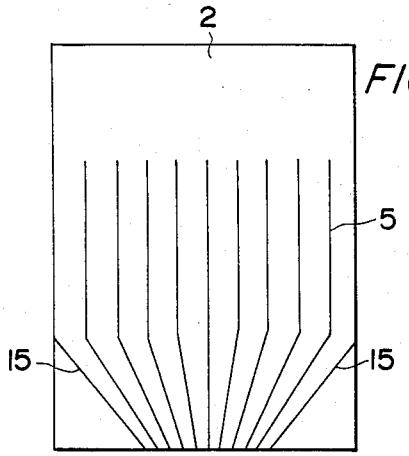
FIG. 4
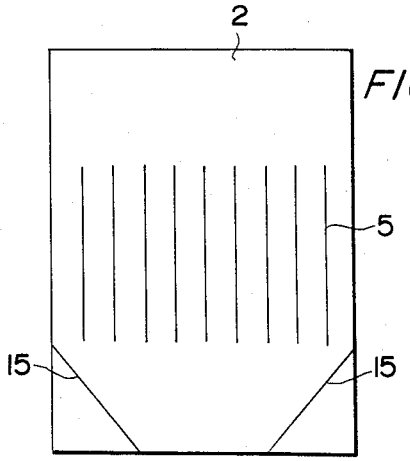
FIG. 5

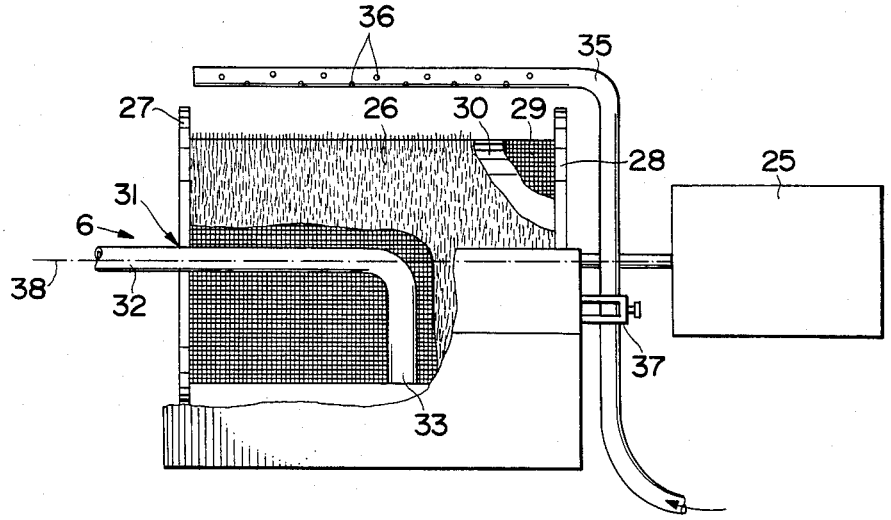
PRIOR ART FIG. 9

METHOD FOR PRODUCING ORIENTED FLEECES OR MATS OF SHORT LENGTH FIBERS

This is a continuation of application Ser. No. 202,176 filed Oct. 29, 1980, now abandoned.

BACKGROUND OF THE INVENTION

The invention relates to a method for producing of oriented short fiber fleeces or mats as tensile strength cores in compound materials made of fiber suspensions. The apparatus has a screen drum rotating in a container. The screen drum has a removable, permeable film on its drum jacket. The apparatus further includes a suction device for producing a pressure drop inside the screen drum. It also includes a chute for supplying the fiber suspension to the surface of the screen drum.

Such an apparatus is known from German Patent Publication (DE-AS) No. 2,163,799 of same applicant. The method described therein comprises that the circumferential speed of the drum jacket is higher than the supply speed of the suspension, that the fibers are deposited on the permeable film on the drum jacket during multiple revolutions of the drum, whereupon the film is cut off and the fleece or mat built up of unidirectionally oriented fibers is removed from the drum together with the film and dried as well as fixed in a manner known as such. In the apparatus used for this purpose, according to FIG. 3, the first orientation of the short fibers takes place during the flowing in the chute. The important fiber orientation effect, however, is achieved by the transition from the chute to the drum by the acceleration of the fiber suspension due to the higher circumferential speed of the drum jacket relative to the flow on speed.

Tests have shown that the exact orientation of the short fibers has a large influence on the strength characteristics of the fiber fleeces or mats to be produced. However, in the free flowing flow of the supply chute according to German Patent Publication (DE-AS) No. 2,163,799, an orientation is hard to perform. Only in the marginal zones of the chute in which the flow speed increases from zero to the flow speed present in the main portion of the chute, a substantial orientation of the short fibers takes place due to the speed change.

OBJECTS OF THE INVENTION

This is where the invention comes in. It is the object of the invention to improve the known apparatus in such a way that the orientation of the short fibers is substantially increased already in the chute.

SUMMARY OF THE INVENTION

According to the invention, the above objective is achieved in that the chute leading onto the screen drum is provided between its side walls with several partitions aligned longitudinally with the flow direction of the fiber suspension.

The advantage achieved by the invention is primarily seen in that when the chute is provided with sufficiently small subdivisions different flow speeds are present in the individual chutes due to the wall friction, said flow speeds having speed components extending across the flow direction, said speed components causing an orientation and thus a densification of the short fibers.

According to a further development of the invention, the subdivisions within the chute are constructed as upwardly open intermediate walls or as pipes or hoses applied to the chute. Further, it is possible to narrow down the outflow zone of the fiber suspension in the chute upstream of the outflow onto the drum. In this embodiment the supply of the fiber suspension onto the drum is either guided also in the narrowed zone by intermediate walls or pipes or it is guided only by the two guide baffles which narrow the fiber suspension flow.

The fiber suspension is accelerated due to the narrowing of the chute whereby in addition to the maximal orientation of the short fibers a substantial densification of the fibers is accomplished. The increase of the supply speed of the fiber suspension does not necessarily require also an increase in the circumferential speed of the drum. It is sufficient, if the circumferential speed of the drum surface is equal to or higher than the supply speed of the fiber suspension.

Tests have shown that a substantially smaller forming or curing pressure is necessary when structural components made of fiber fleeces or mats produced according to the invention are subjected to a finish pressing and curing, in order to achieve the desired density and strength. Thus, it has become possible to press and cure with these fleeces or mats also large surface area structural components in an autoclave in which, as is known, only pressures of up to a maximum of 10 bar are permissible. This is accomplished without any reduction in strengths and stiffness due to fiber proportions which are normally too small for such purposes. In spite of this small forming pressure, it has become possible to increase the bending strength by about 50% and the modulus of bending by about 20% as compared to the apparatus forming part of the prior art. This means that the strength characteristics of structural components made of short fiber fleeces or mats achieve almost the values corresponding to structural components made of endless fibers.

Example embodiments of the invention are shown in the drawing and will be described in more detail below.

BRIEF DESCRIPTION OF THE DRAWINGS

FIG. 1 shows a flow profile of a chute which is not subdivided according to the prior art.

FIG. 2 shows a flow profile of a chute with partition walls.

FIG. 3 shows a perspective illustration of the supply of the fiber suspension through the chute with partition walls onto a drum filter.

FIG. 4 shows a top plan view of a chute provided with partition walls and a narrowing of the flow out in which the intermediate partition walls are also present in the narrowed zone.

FIG. 5 shows a chute corresponding to FIG. 4 in which the intermediate walls are arranged only in the straight portion.

FIG. 9 is an elevational view, partially in section, of the drum filter with the drive and the washing device according to the prior art.

Figure 6:
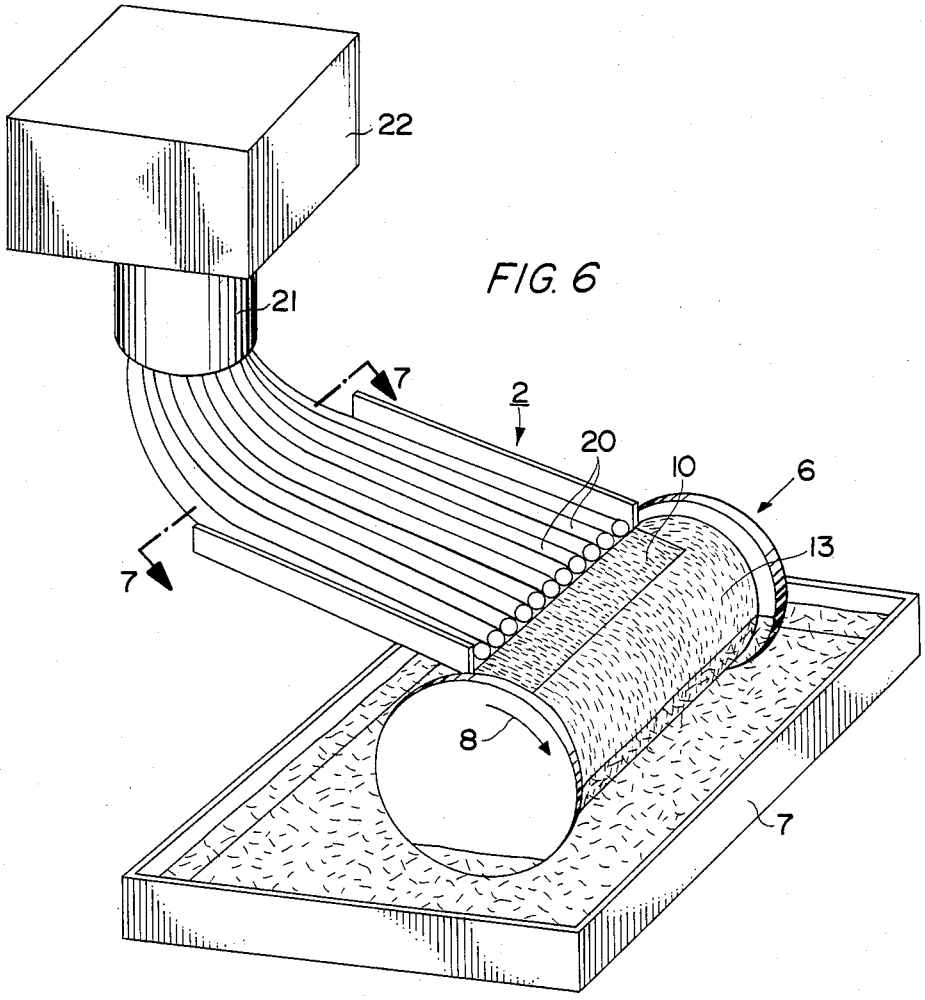
FIG. 6 shows a supply of the fiber suspension by means of pipes or hoses placed onto the chute.

DETAILED DESCRIPTION OF PREFERRED EXAMPLE EMBODIMENTS AND OF THE BEST MODE OF THE INVENTION

The speed profile in a chute 2 without partitioning of the suspension flow is illustrated in accordance with FIG. 1 so as to show that at the edges 3 there is a speed equal 0. The speed grows along a curve corresponding approximately to a parabola toward a maximum speed 4 remaining the same over the entire chute cross section. Thus, the speed exerts a directional force onto the short fibers by way of a vector effect only within the strips between the margins 3 and the point where the maximum speed 4 is reached. This directional force is achieved in that the suspension flow in the speed strip comprises a horizontal speed component. However, if the chute 2 is partioned by the intermediate partition walls 5 relative to the short length of the fibers as shown in FIG. 2, it is possible to achieve by the selection of the spacings between the intermediate partition walls 5 that the maximum speed 4 is reached in the center between the intermediate walls 5 whereby always a fiber orienting, horizontal flow speed component is effective on the short fibers. Such horizontal flow speed component is effective from both adjacent partition walls 5 or from a partition wall and an adjacent side wall 3 as best seen in FIG. 2.

According to FIG. 3 showing a simplified illustration, the apparatus 1 for producing of short fiber fleeces or mats has a chute 2 with intermediate walls 5, a drum 6 and a receptacle 7 whereby the drum 6 rotates in the direction of the arrow 8. A stirring apparatus not shown supplies a suspension 10, for example of glycerine and short fibers, onto the chute 2. The suspension is distributed completely between the edges 3 of the chute 2 by means of a divider body 11. Thereafter the suspension 10 is guided through the intermediate walls 5 which exert the described aligning effect on the short fibers so that the fibers exit well pre-aligned onto a lip 12. Due to the flowing of the suspension 10 onto the surface 13 of the drum 6 which rotates with the same or a higher circumferential speed than the supply speed of the suspension 10, the short fibers are subjected to a further aligning effect.

The shown arrangement produces an extremely uniform fleece or mats of aligned short fibers as compared to a chute 2 constructed without any intermediate walls 5. An improvement may yet be achieved if the entire chute 2 is moved back and forth in the direction of the axis of the drum 6 corresponding to the arrows 16 and 17. In this connection it is sufficient if the movement corresponds to one-half of the width of the intermediate space between the intermediate walls 5 whereby the movement may be accomplished in a manner not illustrated, for example, by means of a known excentric drive.

For densifying the short fibers when the fiber suspension 10 flows out of the chute 2 over the lip 12 onto the drum 6, it is possible to narrow the lower supply end of the chute 2 by slantedly arranged guide baffles 15. In this embodiment there is the possiblity as shown in FIG. 4 that also the intermediate walls 5 extend all the way to the lower edge of the chute 2 in analog to the guide plates 15. However, as shown in FIG. 5 in most instances of application it should be sufficient to arrange the intermediate walls 5 only in the laminar flow portion of the chute 2 because the short fibers retain their direction in the accelerated flow portion between the guide plates 15. There is further the possiblity of constructing the chute without intermediate walls and only with a narrowing for producing of narrow fiber fleeces.

Figure 7:
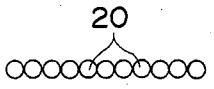
FIG. 7 is a sectional view along sectional line VII—VII in FIG. 3 through the pipes or hoses.
Figure 8:
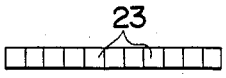
FIG. 8 is a further example embodiment corresponding to FIG. 4 and using four-cornered pipes.

According to a further embodiment as shown in FIG. 6, the aligning of the fibers in the suspension 10 is accomplished by thin walled pipes or hoses 20 applied tightly one next to the other onto the chute 2. The pipes or hoses 20 are secured in a distributor 21 outside the chute 2. The fiber suspension 10 thus flows out of a container 22 through the distributor 21 into the pipes or hoses 20 in which the suspension obtains a uniform speed and then onto the surface 13 of the drum 6. Due to the long distance in thin pipes or hoses 20, a complete alignment of the short fibers is achieved. The section VII—VII shown in FIG. 7 shows the pipes or hoses tightly arranged one next to the other. An even better flow with a uniform flow profile is achieved if, in accordance with FIG. 8, thin four-cornered pipes 23 are used which are arranged tightly one next to the other. In the embodiment according to FIG. 6 it may also be advantageous, as has been described above with reference to FIG. 3, to move the chute 2 back and forth in the direction of the drum axis in accordance with the arrows 16 and 17.

The construction of the drum 6 which is already known from German Patent (DE-PS) No. 2,163,799 of the same applicant, shall be explained in more detail with reference to FIG. 9. The drum 6 may be driven by means of an electric motor 25 including a continuous closed loop control. The majority of the fibers contained in the suspension 10 is deposited on the drum surface as a uniform layer 26 when the suspension runs onto the rotating drum. The thickness of the layer 26 increases with each revolution of the drum 6. The individual short fibers which form this layer 26 are unidirectionally aligned on the drum surface in parallel to the edges 27 and 28 of the drum. The adhesion of the fibers on the drum jacket is caused by a pressure drop of the atmospheric air outside the drum toward the interior of the drum. For this purpose the drum jacket is made of a fine meshed netting structure 29 which is covered with a permeable filter film or foil 30 made of paper, textile or synthetic material prior to starting the apparatus.

A vacuum conduit 32 reaches into the interior of the drum by means of a vacuum tight bearing 31. The end 33 of the vacuum conduit 32 is bent downwardly so that the vacuum effect sucks off the liquid which flows onto the drum jacket with the fiber suspension 10 on the one hand. On the other hand, a reduced air pressure space is formed inside the drum so that the reinforcing fibers applied to the outside of the drum jacket adhere. The thickness of the layer 26 is influenced by the duration of the fiber application to the rotating drum filter 6 and by the more or less strong concentration of the suspension 10. The thickness is selectable.

The layer 26 is cleaned by means of a suitable liquid to remove the adhering remainders of the glycerine forming the suspension liquid. This cleaning is accomplished by means of a shower device comprising a shower pipe 35 with shower openings 36. The shower is clamped by means of a holder 37 to the housing of the receptacle for vertical adjustment in a removable manner. After washing the fleece or mat which comprises the layer 26 of reinforcing fibers lying on the film 30 in an aligned manner, however not yet fixed, the fleece or mat is removed from the drum 6 by a severing incision extending substantially in the direction of the drum axis 38. Thereafter the fleece or mat is dried whereby the foil 30 functions as a carrier for the fibers. Thereafter the fibers are fixed or bonded in a conventional manner in a suitable solution forming a bonding matrix after the curing of the bonding solution. Although the invention has been described with reference to specific example embodiments, it will be appreciated, that it is intended to cover all modifications and equivalents within the scope of the appended claims.

I claim:

1. A method for producing fiber fleeces or mats of fibers having a relatively short length, said short length fibers being held in a suspension of said short length fibers in a suspension liquid in a container, by flowing the suspension through a chute in a flow direction from the container onto an air permeable film on a rotatable screen drum, comprising the following steps:

(a) causing a reduced pressure inside said screen drum, (b) subdividing by partitions at least a length portion of the chute across the entire chute width into a plurality of narrow flow channels having a given flow width between adjacent partitions extending in parallel to one another in the flow direction, (c) selecting the sidth of each narrow flow channel in a direction across the flow direction to be sufficiently small relative to said short fiber length so that the individual short fibers are exposed, due to wall friction, to flow speed components extending across the flow direction in each narrow flow channel, so that the maximum flow speed is reached in each narrow flow channel substantially in the center between two adjacent partitions, and so that the minimum flow speed is reached in each flow channel substantially next to the partitions, for longitudinally aligning the individual short fibers substantially in parallel to one another in the flow direction in each narrow flow channel prior to any curing, said longitudinal aligning of said short fibers resulting in a substantially smaller curing pressure required in a subsequent curing step and yielding improved strength characteristics of the finished fleece or mat, (d) rotating the screen drum at a circumferential speed which is equal to or larger than the flow out speed of the suspension from the chute, accelerating the flow through an outlet end of the chute just prior to flowing the suspension onto the screen drum, by reducing the cross-sectional flow area of said outlet end of the chute by baffle plates, and extending said narrow flow channels into said outlet end of reduced cross-sectional flow area whereby the flow speed is increased in each of said narrow flow channels.

2. The method of claim 1, further comprising moving the chute back and forth in a direction extending perpendicularly to the flow direction, said back and forth movement corresponding at least to one half of the given width of the flow channels of the chute.

3. The method of claim 1, comprising forming the flow channels of the chute by means of partition walls (5) which keep the flow channels upwardly open.

4. A method for producing fiber fleeces or mats of fibers having a relatively short length, said short length fibers being held in a suspension of said short length fibers in a suspension liquid in a container, by flowing the suspension through a chute in a flow direction from the container onto an air permeable film on a rotatable screen drum, comprising the following steps;

(a) causing a reduced pressure inside said screen drum, (b) subdividing by partitions at least a length portion of the chute across the entire chute width into a plurality of narrow flow channels having a given flow width between adjacent partitions extending in parallel to one another in the flow direction, (c) selecting the width of each narrow flow channel in a direction across the flow direction to be sufficiently small relative to said short fiber length so that the individual short fibers are exposed, due to wall friction, to flow speed components extending across the flow direction in each narrow flow channel, so that the maximum flow speed is reached in each narrow flow channel substantially in the center between two adjacent partitions, and so that the minimum flow speed is reached in each flow channel substantially next to the partitions, for longitudinally aligning the individual short fibers substantially in parallel to one another in the flow direction in each narrow flow channel prior to any curing, said longitudinal aligning of said short fibers resulting in a substantially smaller curing pressure required in a subsequent curing step and yielding improved strength characteristics of the finished fleece or mat, (d) rotating the screen drum at a circumferential speed which is equal to or larger than the flow out speed of the suspension from the chute, and forming said narrow flow channels by arranging a plurality of thin pipes or hoses in a row along the chute parallel to each other with the pipes or hoses discharging the suspension onto the chute prior to the drum.

5. The method of claim 4, further comprising moving the chute back and forth in a direction extending perpendicularly to the flow direction, said back and forth movement corresponding at least to one half of the given width of the flow channels of the chute.

* * * * *